US010117503B1

(12) United States Patent
Pinholster, Jr. et al.

(10) Patent No.: US 10,117,503 B1
(45) Date of Patent: Nov. 6, 2018

(54) HAMMOCK WITH INTEGRATED LIGHTS

(71) Applicant: Eagles Nest Outfitters, Inc., Asheville, NC (US)

(72) Inventors: Peter G. Pinholster, Jr., Asheville, NC (US); James Christian Frinak, Asheville, NC (US)

(73) Assignee: Eagles Nest Outfitters, Inc., Asheville, NC (US)

( * ) Notice: Subject to any disclaimer, the term of this patent is extended or adjusted under 35 U.S.C. 154(b) by 287 days.

(21) Appl. No.: 15/294,211

(22) Filed: Oct. 14, 2016

Related U.S. Application Data

(60) Provisional application No. 62/275,012, filed on Jan. 5, 2016.

(51) Int. Cl.
*A45F 3/22* (2006.01)
*A45F 3/00* (2006.01)

(52) U.S. Cl.
CPC ..... *A45F 3/22* (2013.01); *A45F 2003/003* (2013.01)

(58) Field of Classification Search
CPC ..... A45F 3/22
USPC ..... 5/120–122, 124, 126
See application file for complete search history.

(56) References Cited

U.S. PATENT DOCUMENTS 2,694,208 A * 11/1954 Christensen ..... A45F 3/22 5/122
4,651,366 A * 3/1987 Lande ..... B62B 3/144 5/118
5,053,931 A * 10/1991 Rushing ..... A45B 3/04 135/910
7,455,427 B1 * 11/2008 Freeman ..... E04H 15/10 135/91
2015/0034137 A1 2/2015 Tanaeim

OTHER PUBLICATIONS https://www.bigagnes.com/Products/Collections?mtnGLOTents; Dec. 10, 2015.

* cited by examiner

*Primary Examiner* — Fredrick C Conley
(74) *Attorney, Agent, or Firm* — Schwartz Law Firm P.C.

(57) ABSTRACT

An illuminating hammock includes a flexible hammock bed, an electrical light assembly, and an elastic light suspension system. The electrical light assembly includes first and second flexible inelastic light strands extending along opposing sides of the hammock bed, and having respective proximal and distal ends. A wire junction is formed at the proximal ends of the light strands. The wire junction resides proximate the first end of the hammock bed with the distal ends of the light strands extending towards the opposite end of the hammock bed. The elastic light suspension system is operatively connected to the light assembly, and is adapted for elastically tensioning the first and second light strands when a user is positioned on the hammock bed.

18 Claims, 5 Drawing Sheets

HAMMOCK WITH INTEGRATED LIGHTS

TECHNICAL FIELD AND BACKGROUND OF THE DISCLOSURE

The present disclosure relates broadly and generally to a hammock with integrated lights, such as single or multicolor high-brightness LED rope (or "strand") lighting. The LED strand lighting may be powered by one or more LED series circuits operatively communicating with a power supply and LED driver. The exemplary LED driver may feature various LED control circuitry including (e.g.) analog or digital dimming which enables brightness adjustment of the LED light output over the full range from 100% to 0%. In one exemplary embodiment, the LED lighting is a soft light that will help a user find his or her hammock, and maneuver in and around the hammock in the dark.

SUMMARY OF EXEMPLARY EMBODIMENTS

Various exemplary embodiments of the present disclosure are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

It is also noted that terms like "preferably", "commonly", and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

According to one exemplary embodiment, the present disclosure comprises an illuminating hammock including a flexible hammock bed, an electrical light assembly, and an elastic light suspension system. The hammock bed has opposing first and second ends, and opposing longitudinal sides extending between the ends. The electrical light assembly comprises first and second flexible inelastic light strands extending along opposing sides of the hammock bed, and having respective proximal and distal ends. A wire junction is formed at the proximal ends of the light strands. The wire junction resides proximate the first end of the hammock bed with the distal ends of the light strands extending towards the opposite end of the hammock bed. A power source is electrically connected to the light assembly for supplying power to the first and second light strands. The elastic light suspension system is operatively connected to the light assembly, and is adapted for elastically tensioning the first and second light strands when a user is positioned on the hammock bed.

The term "hammock" refers broadly herein to any hanging bed, seat, couch, or other suspended or partially suspended support or sling made of any rigid and/or flexible material including canvas, netted cord, rigid framing or the like. Exemplary hammocks may have cords attached to supports at one or both ends.

According to another exemplary embodiment, the first and second light strands comprise LED lights, such as single or multicolor high-brightness LEDs.

According to another exemplary embodiment, the power source comprises a battery. Other sources of direct current may comprise thermocouples, solar cells, dynamos, or the like.

According to another exemplary embodiment, the hammock bed comprises an integrated battery pocket adapted for receiving and holding the battery.

According to another exemplary embodiment, an integrated stuff sack is located at the first end of the hammock bed, and having an opening adapted for collecting and holding the hammock in a folded condition for storage and transport.

According to another exemplary embodiment, the light assembly has a generally Y-shaped wire configuration. The exemplary wire configuration comprises at least one lead wire extending from the wire junction to the battery.

According to another exemplary embodiment, first and second longitudinal sleeves are integrally formed with respective sides of the hammock bed, and define openings for receiving the first and second light strands of the light assembly.

According to another exemplary embodiment, the battery has a hand-operated switch for selectively activating the first and second light strands.

According to another exemplary embodiment, the light suspension system comprises at least one elastic cord connecting the light assembly to the hammock bed.

According to another exemplary embodiment, the light suspension system comprises first and second elastic cords attached to distal ends of respective first and second light strands, and connecting the first and second light strands to the second end of the hammock bed.

In another exemplary embodiment, the present disclosure comprises a method for illuminating a hammock. The method includes installing first and second flexible inelastic light strands of an electric light assembly along opposing sides of a hammock bed. The light strands have respective proximal and distal ends, and a wire junction at the proximal ends of the light strands. The wire junction resides proximate a first end of the hammock bed with the distal ends of the light strands extending towards a second end of the hammock bed. The light assembly is electrically connected to a power source for supplying power to the first and second light strands. The distal ends of the light strands are attached to first and second elastic cords of an elastic suspension system, whereby the suspension system is adapted for elastically tensioning the first and second light strands when a user is positioned on the hammock bed. The power source is controlled to selectively illuminate the first and second light strands.

BRIEF DESCRIPTION OF THE DRAWINGS

Exemplary embodiments of the present disclosure will hereinafter be described in conjunction with the following drawing figures, wherein like numerals denote like elements, and wherein.

DESCRIPTION OF EXEMPLARY EMBODIMENTS AND BEST MODE

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Figure 1:
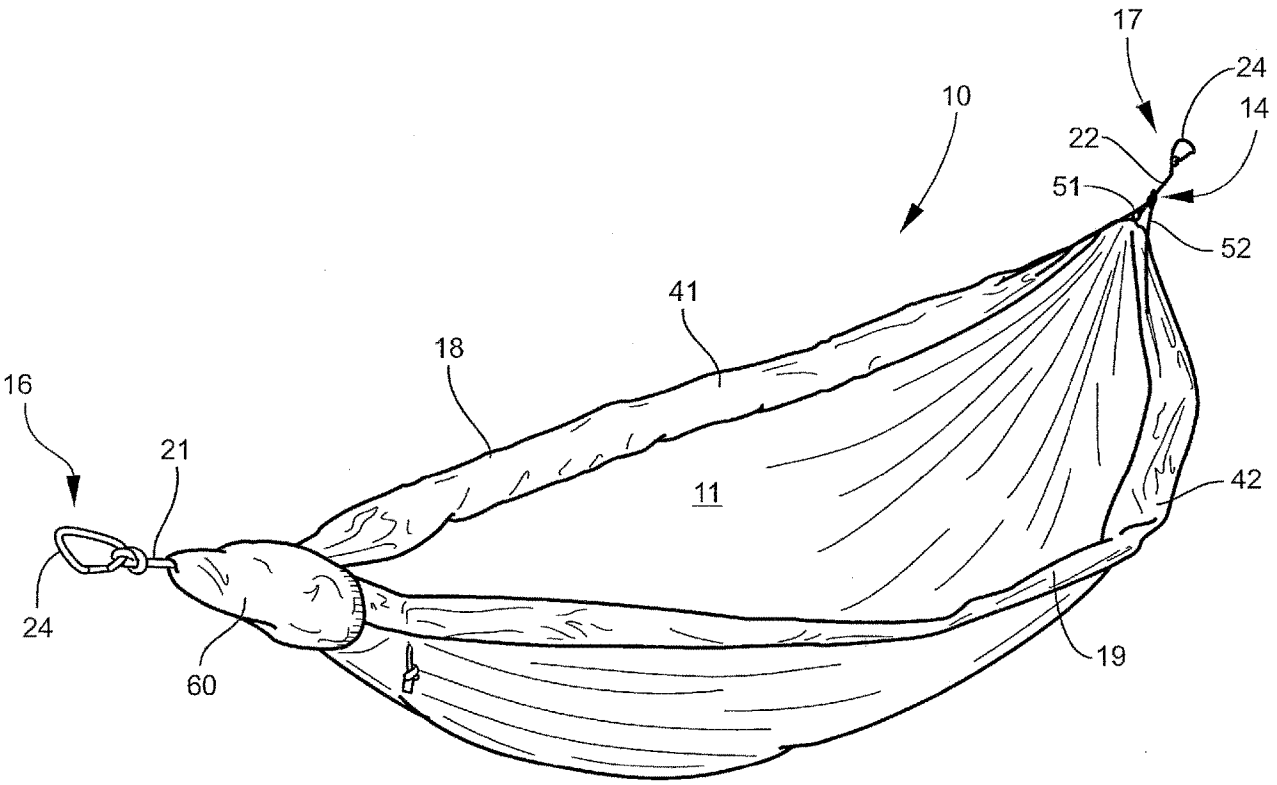
FIG. 1 is a perspective view of the exemplary illuminating hammock with the LED light strands deactivated.
Figure 2:
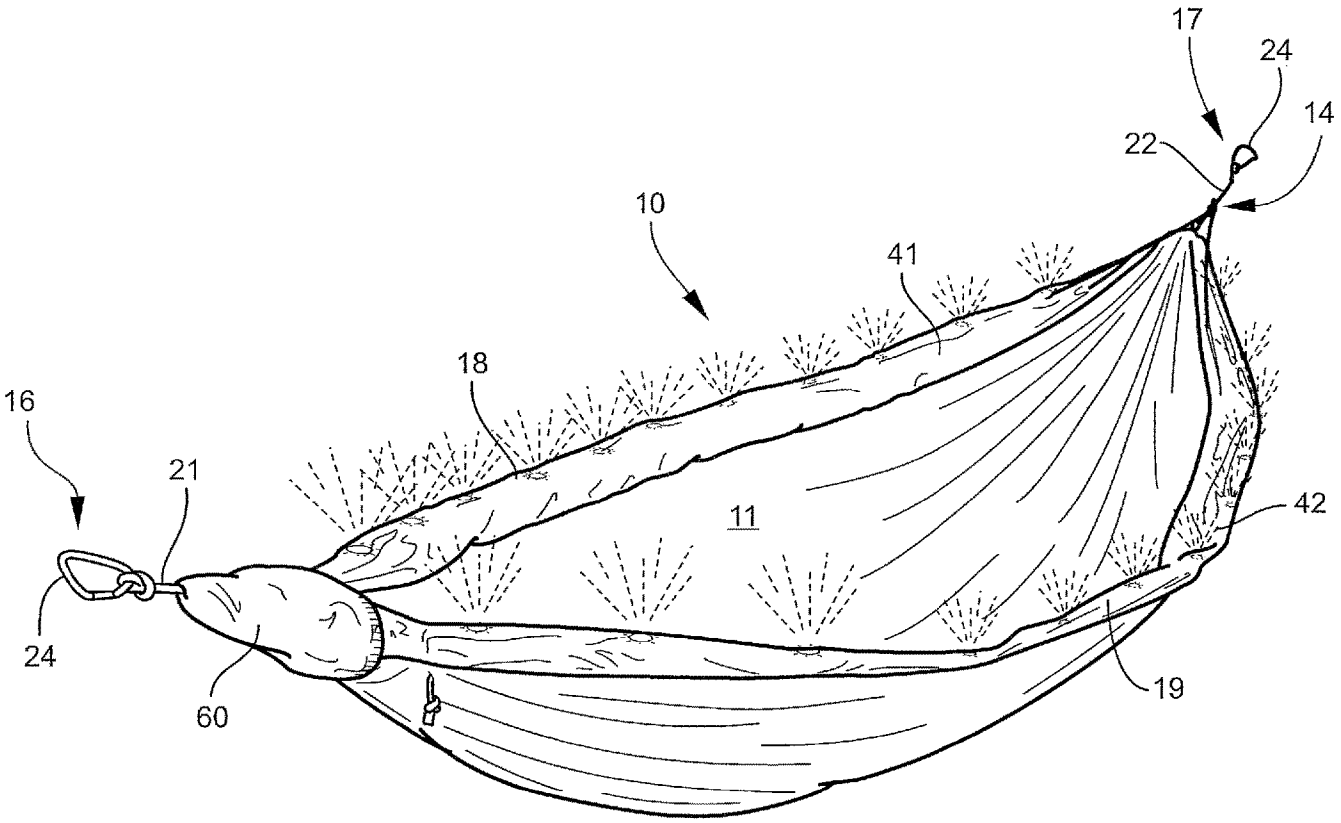
FIG. 2 is a perspective view of the exemplary illuminating hammock with the LED light strands activated.

Referring now specifically to the drawings, an illuminating hammock according to one exemplary embodiment of the present disclosure is illustrated in FIGS. 1 and 2, and shown generally at broad reference numeral 10. The exemplary hammock 10 includes a flexible hammock bed 11, an integrated electrical light assembly 12 (FIG. 3), and an elastic light suspension system 14. The hammock bed 11 is constructed of a lightweight durable and breathable quick drying fabric, such as nylon, and has opposing head and foot ends 16, 17 and opposing longitudinal sides 18, 19. The hammock bed may be single or double nest, and may have a load capacity of 400 pounds or more. Short attachment cords 21, 22 are located at head and foot ends 16, 17 of the hammock bed 11, and may be tied to respective karabiners 24 (snap hooks, S-hooks, O-rings, D-rings, and/or other hardware). In one exemplary embodiment, looped hammock straps such as that disclosed in Applicant's prior issued U.S. Pat. Nos. 9,003,579 and 9,320,343 may be used for readily suspending the hammock 10 from supporting structure at a desired elevation above the ground. The complete disclosure of Applicant's prior patents is incorporated herein by reference.

Figure 3:
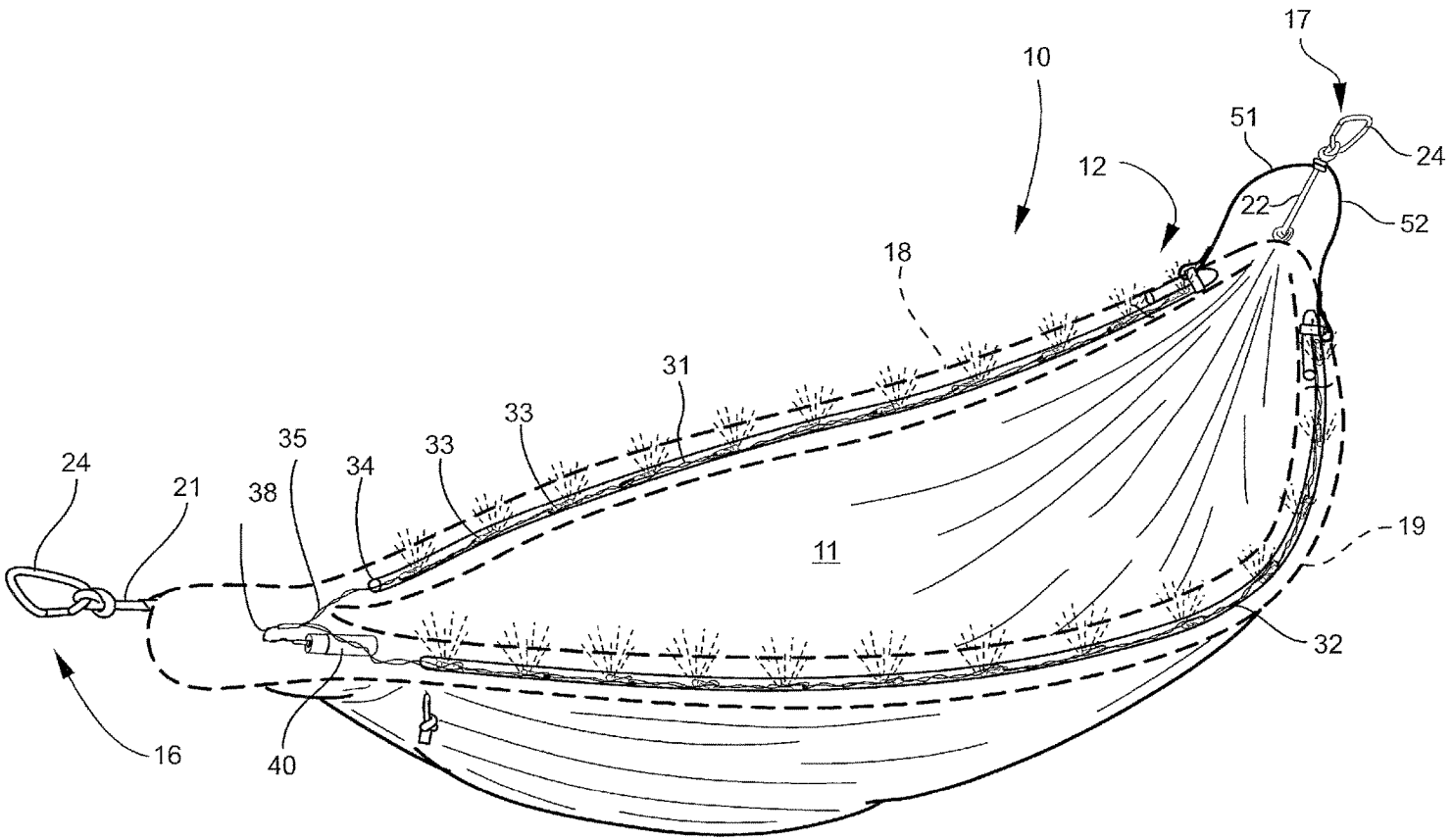
FIG. 3 is a further perspective view of the exemplary illuminating hammock with the LED light strands activated, and showing portions of the hammock bed in phantom.
Figure 6:
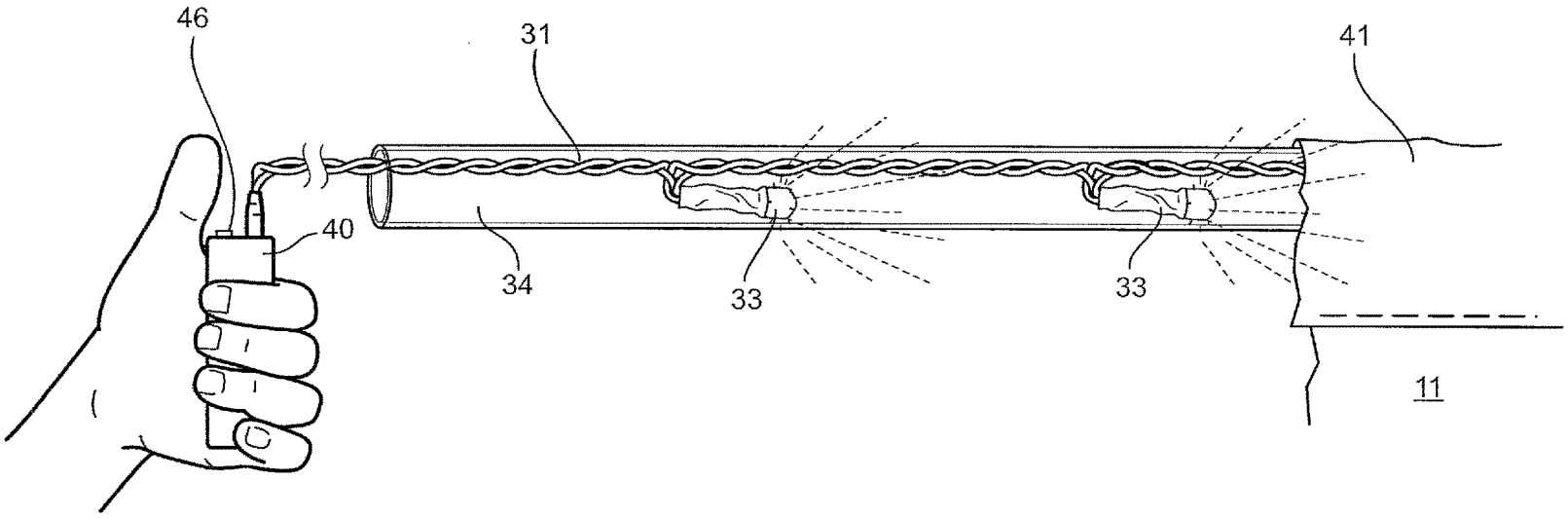
FIG. 6 is a view demonstrating use of the handheld battery box to selectively activate the LED light strand.

Referring to FIGS. 2, 3 and 6, the electrical light assembly 12 comprises first and second flexible inelastic light strands 31, 32 extending along opposing sides 18, 19 of the hammock bed 11, and incorporating single or multicolor high-brightness LED lights 33 sheathed in flexible clear plastic tubing 34. The LED lights 33 may be longitudinally spaced apart about 6-8 inches, and are designed to emit a soft illuminating glow intended to help the user find his or her hammock 10 and to maneuver in and around the hammock 10 in the dark. The light strands 31, 32 have a generally Y-shaped wiring configuration connecting the strands together at a wire junction 35, and comprising twisted lead wires 38 extending from the wire junction 35 and electrically (operatively) connecting to a hand-held battery box 40. The wire junction 35 is located at proximal ends of light strands 31, 32 near the head end 16 of hammock bed 11, while distal ends of light strands 31, 32 extend along opposite sides 18, 19 of the hammock bed 11 towards the foot end 17.

Figure 4:
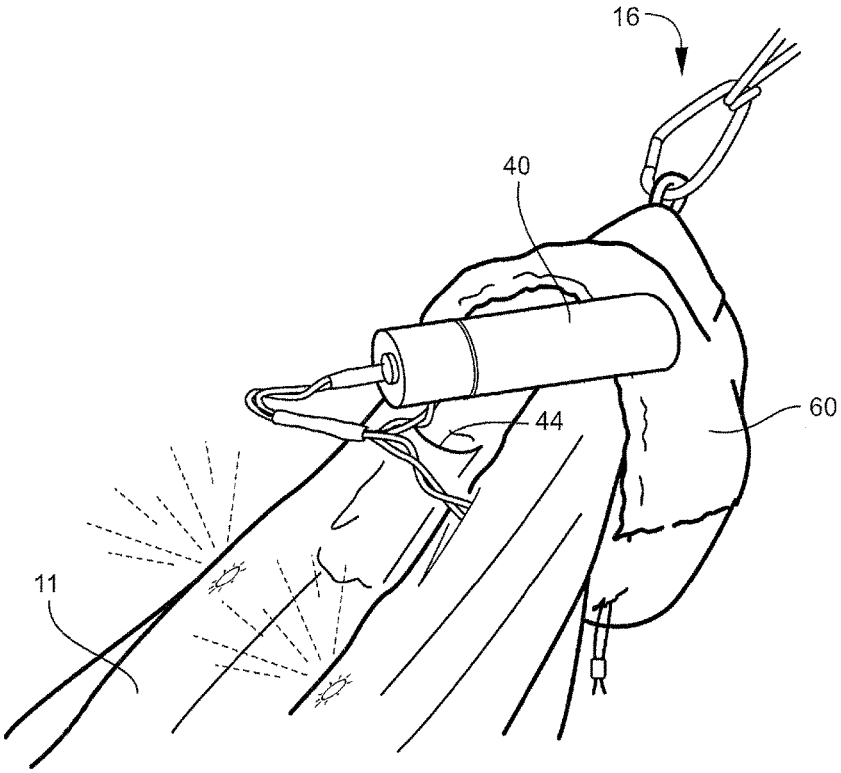
FIG. 4 is a fragmentary view showing a head end of the exemplary hammock, and the battery box removed from a battery pocket formed with the hammock bed.
Figure 5:
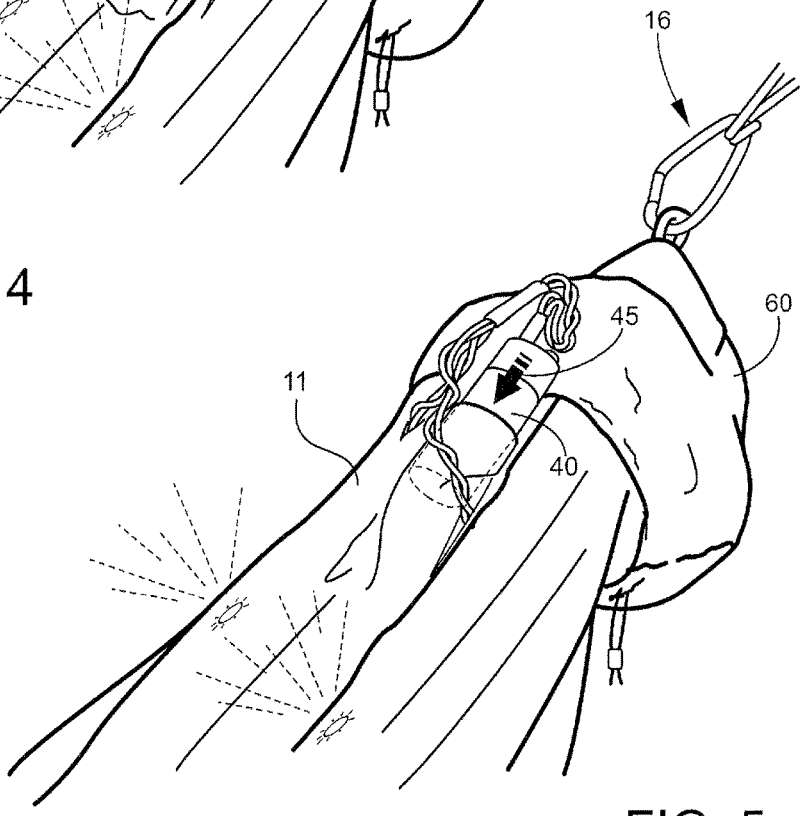
FIG. 5 is a fragmentary view showing a head end of the exemplary hammock, and the battery box being inserted into the battery pocket.

As best shown in FIGS. 1, 2 and 6, the hammock bed 11 comprises hemmed light sleeves 41, 42 integrally formed (e.g., sewn) with respective sides 18, 19, and defining openings for slidably receiving the two light strands 31, 32. In alternative embodiments, the light strands 31, 32 may be carried on the hammock bed 11 by any other means including releasable fasteners, adhesives, heat welding, or the like. An integrated fabric battery pocket 44 shown in FIGS. 4 and 5 is located at the head end 16 of the hammock bed 11, and defines an opening for receiving and storing the battery box 40 as indicated at arrow 45. The exemplary battery box 40 houses three AAA batteries, and has a hand-operated control switch 46 for selectively activating the two light strands 31, 32—either simultaneously or individually. Alternatively, the light strands 31, 32 may be individually powered by two separate power sources. As discussed further below, the exemplary LED lights 33 may have multiple functions including bright, dim, flash and fast flash.

In one basic example, the two LED light strands 31, 32 utilize a common constant-current, closed-loop-control LED driver circuit. In this circuit, the LED current is sensed through a resistor in series with the LED strands 31, 32. The voltage across the resistor, proportional to the LED current, is then used by the feedback (FB) input pin of a regulator to adjust the control mechanisms and modify the voltage applied to the LED strands 31, 32 in order to maintain the current through it constant. By artificially manipulating the signal going into the regulator's FB pin, the LED driver's constant-current value can be altered and adjusted. Analog dimming can be achieved by adjusting the LED current (and hence the LED brightness) through a DC control voltage using, for example, a simple potentiometer. The LED driver may further control LED flashing and the rate of LED flashing. In the exemplary hammock 10, the LED lights 33 are white, but options may be provided for different colors of lights, and an option for lights that fade between a series of different colors.

Referring to FIGS. 1 and 3, the elastic light suspension system 14 is operatively connected to the light assembly 12, and comprises first and second elastic cords 51, 52 attached to distal ends of respective first and second light strands 31, 32 and to the short attachment cord 22 (or karabiner 24) at the foot end 17 of the hammock bed 11. The elastic cords 51, 52 are designed to elastically tension the light strands 31, 32 inside the hemmed sleeves 41, 42 of the hammock bed 11 allowing sufficient "stretch" to protect the electrical wiring from damage when a user is positioned on the hammock.

In the exemplary embodiment, an integrated compression (nylon) stuff sack 60 shown in FIGS. 1, 2, 4 and 5 is located at the head end 16 of the hammock bed 11, and has an elastic opening adapted for being pulled over the pocketed battery box 40 and electrical wiring of the light assembly 12 when the hammock 10 is suspended in an in-use condition. The stuff sack 60 is used to collect and hold the hammock 10 in a folded condition for storage and transport.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under 35 U.S.C. § 112(f) [or 6th paragraph/pre-AIA] is not intended. Additionally, it is not intended that the scope of patent protection afforded the present invention be defined by reading into any claim a limitation found herein that does not explicitly appear in the claim itself.

What is claimed:

1. An illuminating hammock, comprising:

a flexible hammock bed having opposing first and second ends, and opposing longitudinal sides extending between said ends;

an electric light assembly comprising first and second flexible inelastic light strands extending along opposing sides of said hammock bed, and having respective proximal and distal ends, and a wire junction at the proximal ends of said light strands, the wire junction residing proximate the first end of said hammock bed with the distal ends of said light strands extending towards the second end of said hammock bed;

a power source electrically connected to said light assembly for supplying power to said first and second light strands; and an elastic light suspension system operatively connected to said light assembly, and adapted for elastically tensioning said first and second light strands when a user is positioned on said hammock bed.

2. The illuminating hammock according to claim 1, wherein said first and second light strands comprise LED lights.

3. The illuminating hammock according to claim 1, wherein said power source comprises a battery.

4. The illuminating hammock according to claim 3, wherein said hammock bed comprises an integrated battery pocket adapted for receiving and holding said battery.

5. The illuminating hammock according to claim 1, and comprising an integrated stuff sack located at the first end of said hammock bed, and having an opening adapted for collecting and holding said hammock in a folded condition for storage and transport.

6. The illuminating hammock according to claim 1, wherein said light assembly comprises a generally Y-shaped wiring configuration.

7. The illuminating hammock according to claim 1, and comprising first and second longitudinal sleeves integrally formed with respective sides of said hammock bed, and defining openings for receiving said first and second light strands of said light assembly.

8. The illuminating hammock according to claim 1, wherein said battery comprises a hand-operated switch for selectively activating said first and second light strands.

9. The illuminating hammock according to claim 1, wherein said light suspension system comprises at least one elastic cord connecting said light assembly to said hammock bed.

10. The illuminating hammock according to claim 1, wherein said light suspension system comprises first and second elastic cords attached to distal ends of respective first and second light strands, and connecting the first and second light strands to the second end of said hammock bed.

11. The illuminating hammock according to claim 1, wherein said battery comprises a hand-operated switch for selectively activating said first and second light strands.

12. The illuminating hammock according to claim 1, wherein said power source comprises a battery.

13. The illuminating hammock according to claim 1, wherein said hammock bed comprises an integrated battery pocket adapted for receiving and holding said battery.

14. The illuminating hammock according to claim 1, and comprising an integrated stuff sack located at the first end of said hammock bed, and having an opening adapted for collecting said hammock in a folded condition for storage and transport.

15. The illuminating hammock according to claim 1, wherein said light assembly comprises a generally Y-shaped wiring configuration.

16. The illuminating hammock according to claim 1, and comprising first and second longitudinal sleeves integrally formed with respective sides of said hammock bed, and defining openings for receiving said first and second light strands of said light assembly.

17. An illuminating hammock, comprising:

a flexible hammock bed having opposing first and second ends, and opposing longitudinal sides extending between said ends;

an electric light assembly comprising first and second flexible inelastic LED light strands extending along opposing sides of said hammock bed, and having respective proximal and distal ends, and a wire junction at the proximal ends of said light strands, the wire junction residing proximate the first end of said hammock bed with the distal ends of said light strands extending towards the second end of said hammock bed;

a power source electrically connected to said light assembly for supplying power to said first and second light strands; and an elastic light suspension system comprising first and second elastic cords attached to distal ends of respective first and second light strands, and connecting the first and second light strands to the second end of said hammock bed, whereby said suspension system is adapted for elastically tensioning said first and second light strands when a user is positioned on said hammock bed.

18. A method for illuminating a hammock, comprising:

installing first and second flexible inelastic light strands of an electric light assembly along opposing sides of a hammock bed, the light strands having respective proximal and distal ends, and a wire junction at the proximal ends of the light strands, the wire junction residing proximate a first end of the hammock bed with the distal ends of the light strands extending towards a second end of the hammock bed;

electrically connecting the light assembly to a power source for supplying power to the first and second light strands;

connecting the distal ends of the light strands to first and second elastic cords of an elastic light suspension system, whereby the suspension system is adapted for elastically tensioning the first and second light strands when a user is positioned on the hammock bed; and controlling the power source to selectively illuminate the first and second light strands.

* * * * *